US008191762B2

(12) United States Patent
Philips

(10) Patent No.: US 8,191,762 B2
(45) Date of Patent: Jun. 5, 2012

(54) INTERLEAVED SPINE CONTAINER

(75) Inventor: Nicholas A. Philips, Spring Gove, IL (US)

(73) Assignee: International Paper Company, Memphis, TN (US)

( * ) Notice: Subject to any disclaimer, the term of this patent is extended or adjusted under 35 U.S.C. 154(b) by 254 days.

(21) Appl. No.: 12/627,559

(22) Filed: Nov. 30, 2009

(65) Prior Publication Data

US 2011/0127318 A1 Jun. 2, 2011

(51) Int. Cl.
*B65D 25/04* (2006.01)

(52) U.S. Cl. ..... 229/120.11; 229/120.18; 229/120.37; 229/143

(58) Field of Classification Search ..... 229/120.11, 229/120.011, 120.18, 120.37, 143
See application file for complete search history.

(56) References Cited

U.S. PATENT DOCUMENTS

| | | | | |
|---|---|---|---|---|
| 1,151,821 | A | 8/1915 | Raynaud | |
| 1,808,922 | A | 6/1931 | Gallistel | |
| 2,089,067 | A | 8/1937 | Myers | |
| 2,233,221 | A | 2/1941 | Olivier | |
| 2,578,775 | A | 12/1951 | Belsinger | |
| 2,648,481 | A | 8/1953 | Belsinger | |
| 2,648,483 | A | 8/1953 | Belsinger | |
| 2,755,963 | A * | 7/1956 | Ringler | 229/120.18 |
| 3,082,929 | A * | 3/1963 | Aquino et al. | 229/120.18 |
| 3,088,648 | A | 5/1963 | Fobiano | |
| 3,208,079 | A | 9/1965 | St. John | |
| 3,300,116 | A | 1/1967 | Grashege | |
| 3,510,046 | A | 5/1970 | Reiner | |
| 3,952,634 | A | 4/1976 | Rollins et al. | |
| 4,039,117 | A * | 8/1977 | Sieffert | 229/120.37 |
| 4,220,076 | A | 9/1980 | Moen | |
| 4,262,837 | A * | 4/1981 | Fremion | 229/120.11 |
| 4,282,999 | A | 8/1981 | Moen | |
| 4,292,034 | A | 9/1981 | Probyn et al. | |
| 4,293,091 | A | 10/1981 | Gerard | |
| 4,396,146 | A | 8/1983 | Sieffert | |
| 4,500,306 | A | 2/1985 | Nowacki | |
| 4,621,766 | A * | 11/1986 | McClure | 229/143 |
| 4,651,918 | A | 3/1987 | Moore et al. | |
| 4,872,589 | A | 10/1989 | Englehart et al. | |
| 5,505,370 | A | 4/1996 | Brown et al. | |
| 5,657,925 | A | 8/1997 | Norris | |
| 6,189,777 | B1 * | 2/2001 | Hutchinson et al. | 229/120.37 |

FOREIGN PATENT DOCUMENTS

| | | |
|---|---|---|
| FR | 2502120 | 9/1982 |
| FR | 2668752 | 5/1992 |
| GB | 2110184 | 6/1983 |

* cited by examiner

*Primary Examiner* — Gary Elkins
(74) *Attorney, Agent, or Firm* — Matthew M. Eslami

(57) ABSTRACT

The present invention is directed to a container having a bottom wall, first and second opposite sidewalls, opposite end walls, a top wall. An integral interior partition is dividing the container into two side-by-side compartments each adapted for holding a respective article. The container and partition are made from a single unitary blank cut and folded to form the container and partition. The partition comprises the first and second panels of the first and second sets of panels that are interleaved with one another at inner end edges thereof and the partition is three panels thick over a center portion thereof and two panels thick over the remainder thereof.

12 Claims, 13 Drawing Sheets

INTERLEAVED SPINE CONTAINER

FIELD OF THE INVENTION

The present invention relates generally to paperboard containers or cartons that are capable of shipping articles, and more particularly, to a container having integral interior partitions and constructed from a single blank.

BACKGROUND OF THE INVENTION

Conventional foldable cartons are well known and are used in a variety of applications. For example, the packaging industry utilizes a vast number of cartons in which numerous products are packaged for subsequent shipment. For certain fragile articles, such as bottles and the like, it is desirable to use shipping cartons containing interior partitions to prevent significant movement and breakage of the articles during shipment.

Such shipping cartons can be manufactured in either one or two pieces. The two-piece carton includes the carton itself and one or more separate dividers. Typically, assembly of the two-piece carton requires two pieces of equipment. The first piece of equipment constructs the carton while the second piece of equipment constructs the dividers. The dividers must then be inserted into the carton in order to form the completed carton. One problem with the two piece container is the ordering, inventorying, and matching wrapper blanks and divider blanks with one another. Another problem is that manufacturers of articles, such as plastic soda bottles, often ship empty bottles in the constructed carton to a bottler. The bottlers then turn the cartons upside-down to remove the empty bottles for entry into the filling line. With the two-piece carton, the separate dividers tend to slide out or become misaligned during this process.

Many products that are currently packaged in two-compartment boxes fit so tightly in the compartments that if the partition or spine that separates the two compartments is of four-wall construction it causes the container dimensions to be enlarged to the point that groups of these containers, when placed on a pallet, overhang the pallet. This detracts from their available strength and/or makes them fall out of compliance with product manufacturer's or retailer's dimensional specifications.

Accordingly, there is need to for a container having an integral interior partitions or spine wherein the container and the partition are constructed from a single blank using one piece of equipment and the partition has no more than a three-wall thickness.

SUMMARY OF THE INVENTION

The container with integral interior partitions is constructed from a single blank using one piece of equipment and thus presents a great cost savings over a container formed from two separate blanks. Another advantage of the present invention relates to its inherent durability since the dividers are integrally attached to the container and glued with one another which is making it more durable with greater stacking strength. In addition, since the dividers are integral to the container, they cannot slide out or become misaligned and thus need no further adjustment.

The present invention thus relates to a container or carton having integral interior partitions constructed by using an apparatus and method for erecting the container from a single blank by a series of cooperating folding and sealing operations. These operations are performed automatically, efficiently and economically. The flat container blanks can then be conveniently and economically shipped to the user who can assemble the container at the manufacturing location of the articles to be shipped.

Accordingly, one aspect of the present invention is directed to a container having a bottom wall, first and second opposite sidewalls, opposite end walls, a top wall. An integral interior partition is dividing the container into two side-by-side compartments each adapted for holding a respective article. The container and partition are made from a single unitary blank cut and folded to form the container and partition. The partition comprises a first panel extending inwardly from the first sidewall across the interior of the container toward the second sidewall. A second panel extends inwardly from the second sidewall across the interior of the container toward the first sidewall and into overlapping relationship at an inner edge thereof with an inner edge of the first panel. The first panel having a width greater than the width of the second panel and the overlapped edges of the first and second panels is being offset from the center of the partition toward the second sidewall. A third panel extends inwardly from the first sidewall across the interior of the container toward the second sidewall. A fourth panel extends inwardly from the second sidewall across the interior of the container toward the first sidewall and into overlapping relationship at an inner edge thereof with an inner edge of the third panel.

The third panel having a width less than the width of the fourth panel, and the overlapped edges of the third and fourth panels is being offset from the center of the partition toward the first sidewall. The first and third panels lies contiguous to one another with an inner edge of the third panel offset from an inner edge of the first panel toward the first sidewall. And the second and fourth panels lies contiguous to one another with an inner edge of the second panel offset from an inner edge of the fourth panel toward the second sidewall. The inner edges of the second and third panels are being interleaved between inner edges of the first and fourth panels to define a triple wall thickness at a center portion of the partition.

Another aspect of the present invention is directed to a container having a bottom wall, opposite sidewalls, opposite end walls, and integral interior partition means dividing the interior of the container into a plurality of side-by-side compartments each adapted for holding a respective article. The container and partition means are made from a single unitary blank cut and folded to form the container and partition. The partition means comprises a first set of two panels extending inwardly partially across the interior of the container from a first of the sidewalls and terminating at inner end edges thereof spaced from a second opposite of the sidewall. A first of the two panels having less width than a second of the two panels so that the inner end edges of the first and second panels of the first set are offset from one another. A second set of two panels extends inwardly partially across the interior of the container from the second of the sidewall and terminating at inner end edges thereof spaced from the first of the sidewall.

A first of the two panels of the second set having less width than a second of the two panels so that the inner end edges of the first and second panels of the second set are offset from one another. The first and second sets of panels are positioned with respect to one another so that the first panels of the first and second sets of panels are in alignment with one another and the inner end edges thereof are in confronting relationship, the second panel of the first set of panels extends alongside of and is secured to one side of the first panels of the first and second sets of panels in spanning relationship to the confronting inner end edges thereof. The second panel of the second set of panels extends alongside of and is secured to an opposite side of the first panels of the first and second sets of panels in spanning relationship to the confronting inner end edges thereof, whereby the first and second panels of the first and second sets of panels are interleaved with one another at inner end edges thereof and the partition means is three panels thick over a center portion thereof and two panels thick over the remainder thereof.

A further aspect of present invention is directed to a single unitary blank for making a container having a bottom wall, opposite sidewalls, opposite end walls, and integral interior partition means dividing the interior of the container into a plurality of side-by-side compartments each adapted for holding a respective article. The blank is cut and scored to define a center wrap section and first and second end piece sections on opposite sides of the center wrap section. The center wrap section comprises a centrally disposed bottom wall panel having opposite end edges and opposite side edges. A first outer sidewall panel is foldably joined to a first side edge of the bottom wall panel and a second outer sidewall panel is foldably joined to a second side edge of the bottom wall panel opposite the first side edge thereof. The first end section comprises a first end wall panel foldably joined to a first end edge of the bottom wall panel. A first inner sidewall panel is foldably joined to one side edge of the first end wall panel and lying adjacent a first edge of the first outer sidewall panel. A second inner sidewall panel is foldably joined to an opposite side edge of the first end wall panel and lying adjacent a first edge of the second outer sidewall panel.

A first partition panel is foldably joined to an outer side edge of the first inner sidewall panel and a second partition panel is foldably joined to an outer side edge of the second inner sidewall panel, the second partition panel having less width than the first partition panel. The second end section comprises a second end wall panel foldably joined to a second end edge of the bottom wall panel opposite the first end edge. A third inner sidewall panel is foldably joined to a side edge of the second end wall panel in opposed relationship to the first inner sidewall panel on an opposite side of the blank. A fourth inner sidewall panel is foldably joined to an opposite side edge of said second end wall panel in opposed relationship to the second inner sidewall panel on an opposite side of the blank. A third partition panel is foldably joined to an outer side edge of the third inner sidewall panel in opposed relationship to the first partition panel on an opposite side of the blank. The third partition panel having less width than the first partition panel, and a fourth partition panel is foldably joined to an outer side edge of the fourth inner sidewall panel in opposed relationship to the second partition panel on an opposite side of the blank, the second partition panel having less width than the fourth transverse partition panel. A top wall panel is foldably joined to an outer edge of each the outer sidewall panel. A laterally projecting small flap is foldably joined to each of the opposite outer end edges of each the top wall panel.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
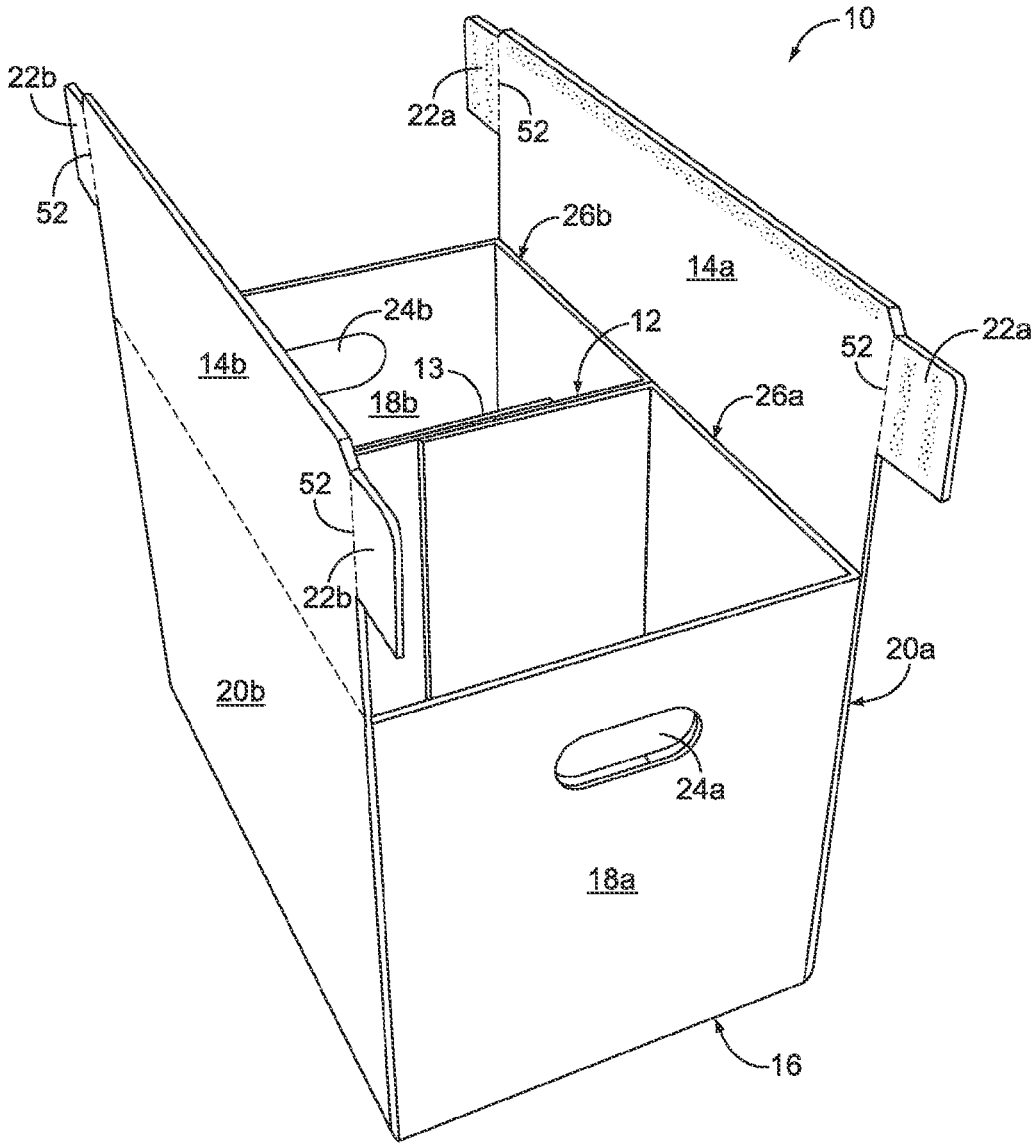
FIG. 1 is a top perspective view of a container comprising integrally formed partition having a three-wall interleaved center spine constructed therein in an open position in accordance to the first embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
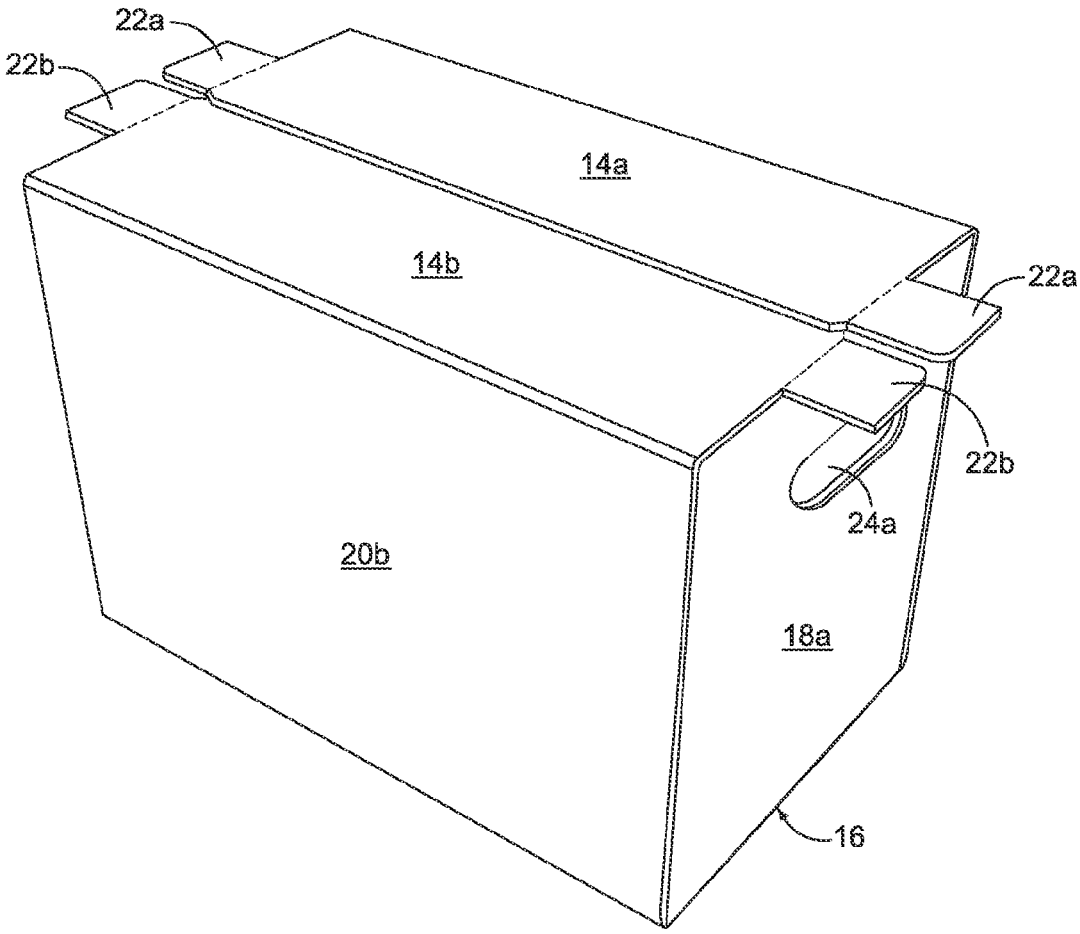
FIG. 2 is similar top perspectives view of the container in FIG. 1 illustrating the top portion of the container in a folded position.
Figure 3:
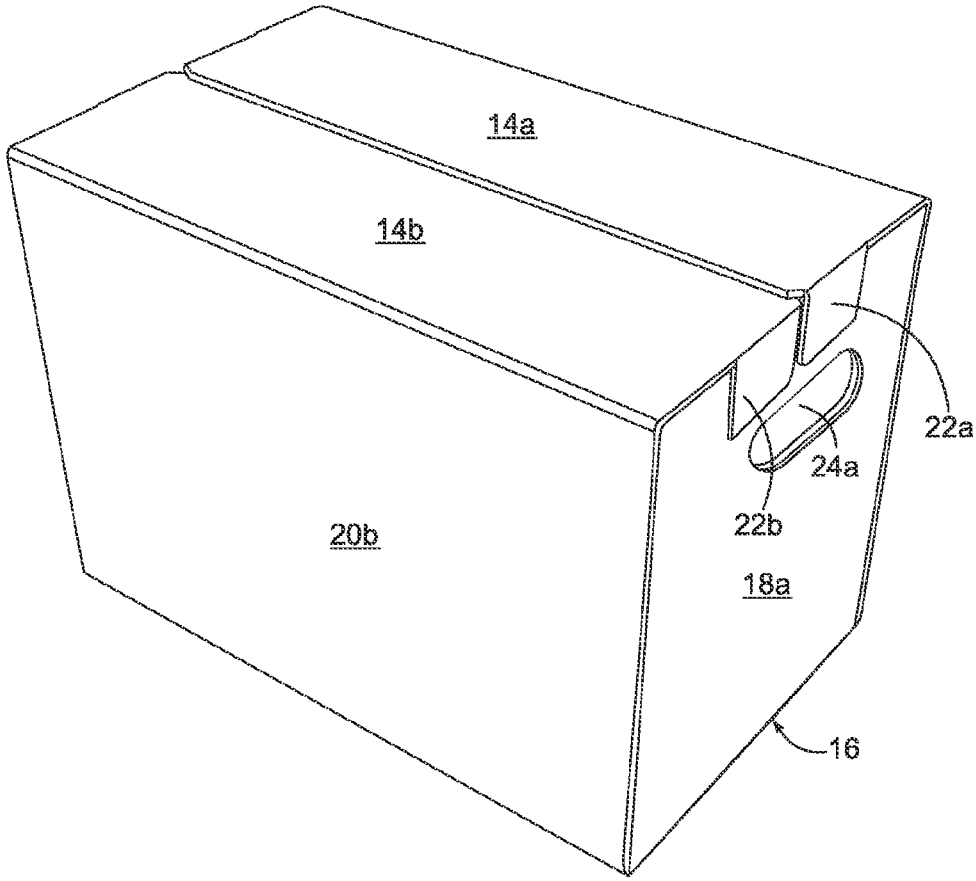
FIG. 3 is a top perspective view of the container in FIG. 2 showing the container in a closed position.

FIG. 1 is a top perspective view of a container 10 comprising an integrally formed partition 12 having a three-wall interleaved center spine 13 constructed therein in an open position in accordance to the first embodiment of the present invention. The container 10 comprises opposing top walls 14*a*, 14*b*, bottom wall 16 opposite end walls 18*a*, 18*b*, and opposite side walls 20*a*, and 20*b*. The opposing top and bottom walls 14*a*, 14*b*, and 16 are spaced apart from one another by the opposite end walls 18*a*, 18*b* and the opposite side walls 20*a*, 20*b*. The opposing top walls 14*a*, 14*b* and the bottom walls 16 are foldably joined to longitudinal opposite edges of the side walls 20*a*, 20*b*, and the end walls 18*a*, 18*b* are foldably joined to transverse opposite edges of the side walls 20*a*, 20*b*. Each of the top wall panel 14*a*, 14*b* includes a pair of flaps 22*a*, 22*b*, respectfully. The opposing top walls 14*a*, 14*b*, bottom wall 16; the opposite end walls 18*a*, 18*b*; and the opposite side walls 20*a*, 20*b* are all cooperating with one another to form the container 10. While this specific embodiment has two side walls 20*a*, 20*b* and two end walls 18*a*, 18*b*, the container 10 of the present invention may have any number of side walls or end walls so long as the container's functions described herein are not compromised. The first and second handhold openings 24*a*, 24*b* are formed in the respective end walls 18*a*, 18*b*. Although the first and second handhold openings 24*a*, 24*b* are optional, but for the present invention, it should also be noted that the hand hold openings 24*a*, 24*b* are formed in a manner that permits a user to carry the container 10 by the handhold openings without compromising the interior of the container 10. Accordingly, the handhold openings 24*a*, 24*b* are tamper-evident that are formed in the end walls 18*a*, 18*b* as shown in FIGS. 1-3. The container 10 may contain any number of hand hold openings; however, in the preferred embodiment of the present invention, the container 10 includes two hand hold openings 24*a*, 24*b*.

The container 10 includes two contiguous cells or compartments or tubular sections 26*a*, 26*b* defined by the partition 12 having a three-wall interleaved center spine 13. The two cells or compartments 26*a*, 26*b* are identical in shape and define interior spaces of the container 10. The center spine 13 when measured from innermost surface on one side (e.g., compartment 26*a*) to innermost surface on the other side (e.g., compartment 26*b*) is three wall thicknesses and the center spine 13 is interleaved. In use, products such as bottles or the like are disposed in the contiguous cells or compartments 26*a*, 26*b* and the top wall 14*a*, 14*b* are folded toward one another to cover the compartments 26*a*, 26*b* and finally, the pair of flaps 22*a*, 22*b* are glued to the end walls 18*a*, 18*b* to enclose the container 10 as depicted in FIGS. 2 & 3. The container 10 of the present invention is capable of being from any one or more blanks that is capable of being folded and erected to form the container 10. However, in the preferred embodiments of the present invention the container 10 is made from one piece blank.

Figure 4:
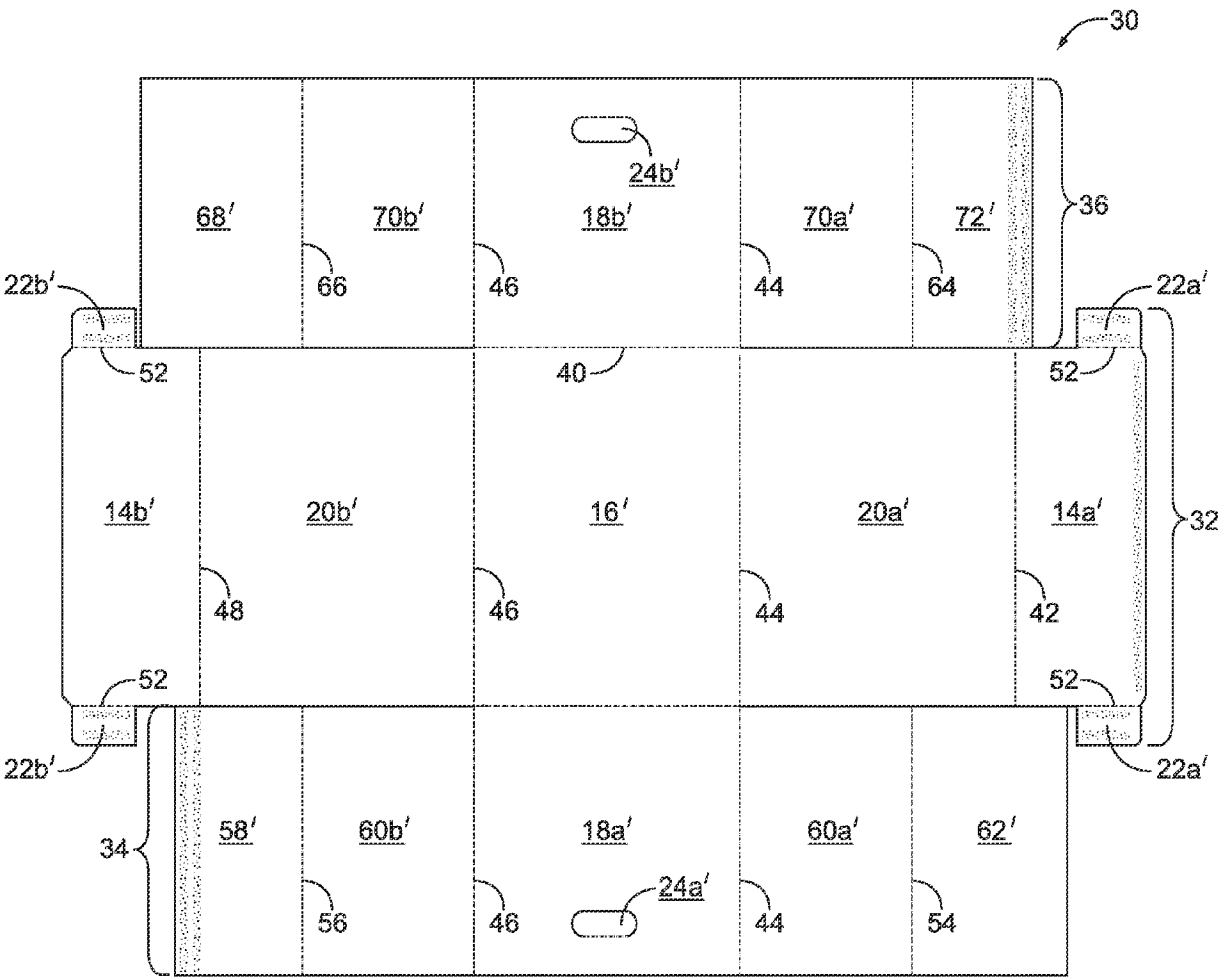
FIG. 4 is a plan view of a cut and scored paperboard blank for forming the container in FIGS. 1-3 in accordance to first embodiment of the present invention.

FIG. 4 shows one such blank, more specifically, is a plan view of a cut and scored paperboard blank 30 for forming the container 10 in FIGS. 1-3 in accordance to the first embodiment of the present invention. The blank 30 is divided into three sections 32, 34, and 36 by two substantially parallel longitudinal fold lines 38, 40. Section 32 is defined as a wrapper and sections 34 and 36 are defined as respective first and second end pieces. The wrapper 32 and the first and second end pieces 34 and 36 are foldably attached to one another via fold lines 38, 40. When constructed, the first and second end pieces 34 and 36 forms the respective cells or compartments or tubular sections 26*a*, 26*b* defined by the three-wall interleaved center spine 13. The wrapper 32 is further divided by fold lines 42, 44, 46 and 48 into five panels, namely, a bottom panel 16', two side wall panels 20*a*', 20*b*' and two top wall panels 14*a*', 14*b*'. In the folded position, the two top wall panels 14*a*', 14*b*' form the top walls 14*a*, 14*b*, the two side wall panels 20*a*', 20*b*' form the side wall panels 20*a*, 20*b*, and the bottom wall panel 16' is the bottom wall 16 of the container. The respective flaps 22*a*', 22*b*' are defined by fold lines 52 and extended outwardly from the respective short edges of the top wall panels 14*a*', 14*b*'. The length of the fold lines 38 and 40 is the same as the width of the bottom wall panel 16'.

The first end piece 34 is divided by fold lines 54, 44, 46 and 56 into five panels 54', 60*a*', 18*a*', 60*b*', and 58' which form the cells or compartments or tubular sections 26*a*, when constructed. Similarly, the second end piece 36 is divided by fold lines 64, 44, 46 and 66 into five panels 72, 70*a*', 18*b*', 70*b*, and 68' which form the cells or compartments or tubular sections 26*b*, when constructed. In the first and second pieces 34 and 36, when in folded position, the respective panels 18*a*', 18*b*' form the end walls 18*a*, 18*b* as shown in FIGS. 1-3. The panels 18*a*', 18*b*' are spaced apart from one another by the bottom wall panel 16'. The substantially parallel fold lines 44 and 46 are formed across the width of the blank 30. When folded, the openings 24*a*', 24*b*' in the respective panels 18*a*', 18*b*' form the hand hold openings 24*a*, 24*b* in a manner that affords a user to carry the container 10. The first and second pieces 34 and 36 are formed in a manner that they are asymmetric with respect to the longitudinal axis of the wrapper and they are staggered or out of phase with one another. For example, respective panels 60*a*', 60*b*', 18*a*' and 70*a*', 70*b*', 18*b*' on the opposed side of the wrapper 32 are identical and they are mirror image of one another with respect to the longitudinal side of the wrapper 32. However, respective panels 62' and 68' and respective panels 58' and 72' are identical without being mirror of one another with respect to the longitudinal side of the wrapper 32.

Figure 4A:
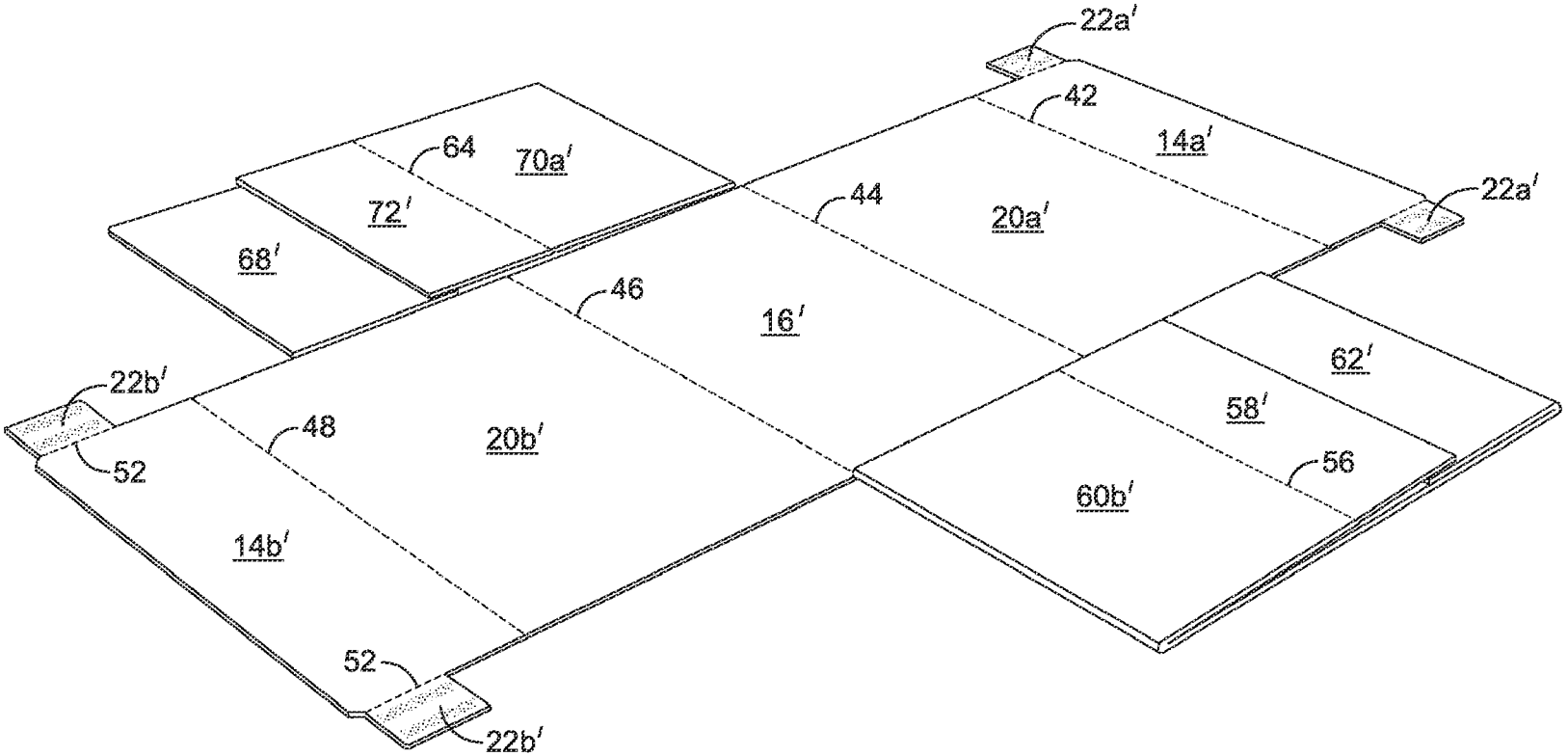
FIGS. 4A, 4B, and 4C illustrate the folding sequences of the blank shown in FIG. 4 for constructing the container depicted in FIGS. 1-3.
Figure 4B:
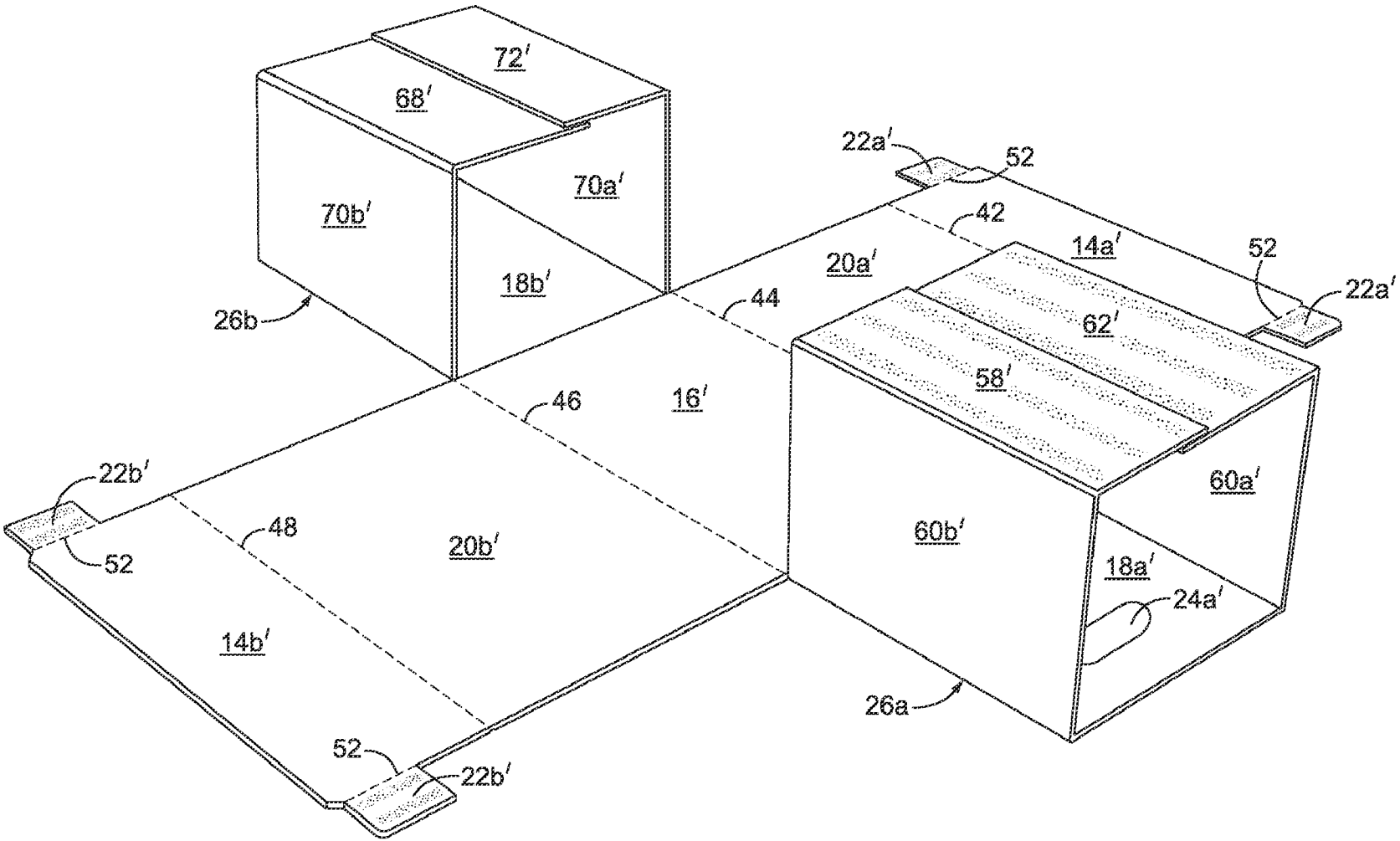
Figure 4C:
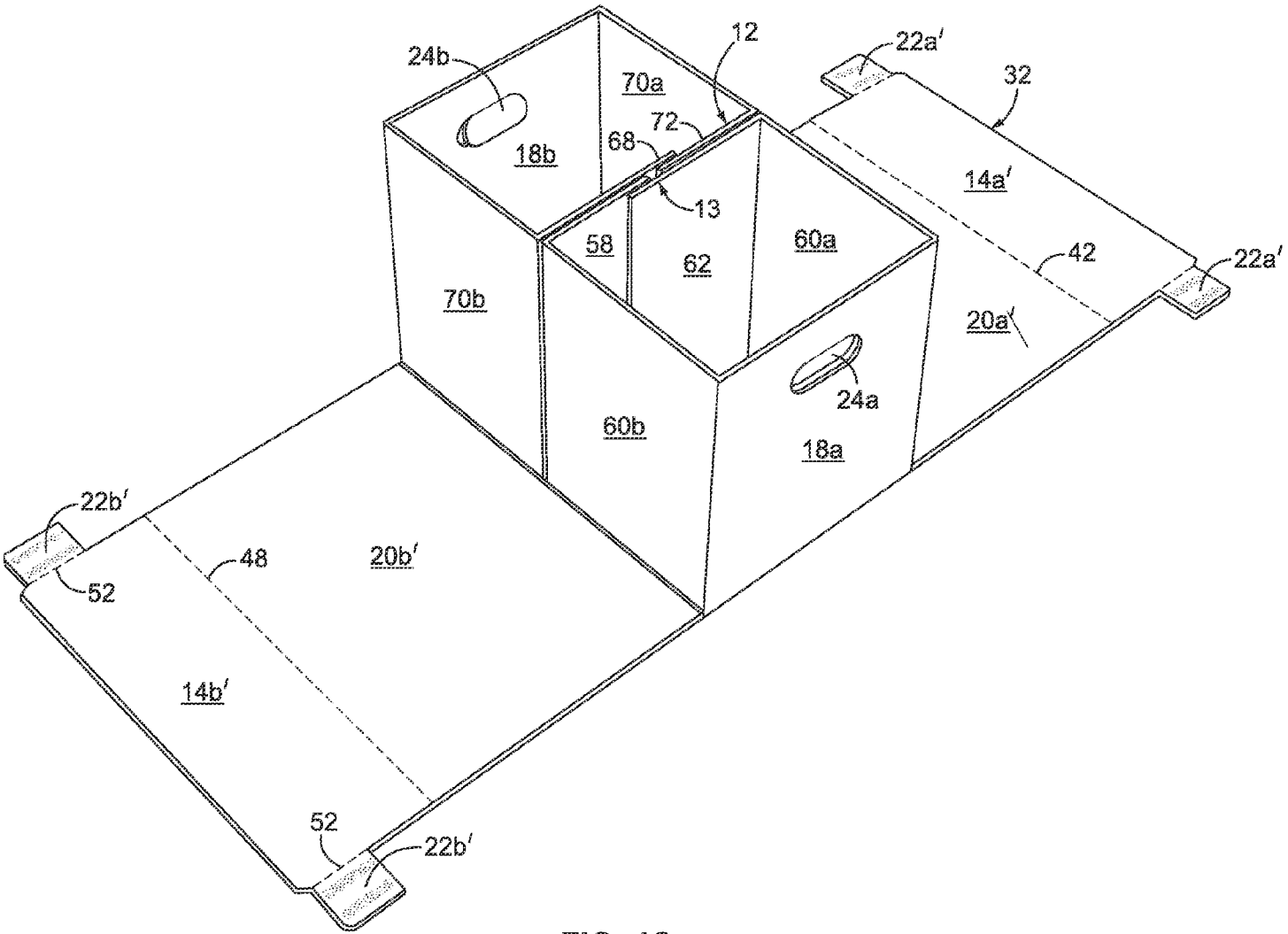

FIGS. 4A, 4B, and 4C illustrate folding sequences of the blank 30 shown in FIG. 4 for constructing the container 10 depicted in FIGS. 1-3. It should be noted that the proper size and configuration of these panels are important to construct the cells or compartments or tubular sections 26*a*, 26*b* that are brought into juxtaposition with one another to form the partition 12 having the three-wall interleaved center spine 13 therein. It should also be noted that the partition 12 is configured such that it has a three-wall thickness in the central portion and a two-wall thickness away from the center spine 13. For example, when the cells or compartments or tubular sections 26*a*, 26*b* are brought into juxtaposition with one another, the longitudinal edge of the panel 58' of the cell 26*a* aligned with the longitudinal edge of the panel 72' of the cell 26*b* such that the center spine 13 is interleaved.

Referring to FIGS. 4A, 4B, and 4C, manual set-up of the container 10 is easily accomplished. However, an ordinary skilled in the art would appreciate that a folding machine automatically performs the forming operations illustrated in FIGS. 4A, 4B, and 4C. Starting with the first piece 34, the panel 62' is folded along the fold line 54 and both panels 58', 60*b*' are folded along the fold line 46 toward one another in an overlapping relationship and then the side edges of panels 58' and 62' are glued to one another. Similarly, with the second piece 36, the panel 68' is folded along the fold line 66 and the both panels 60*a*', 72' are folded along the fold line 44 toward one another in an overlapping relationship and then the overlapped portion of panels 72' and 68' are glued to one another as depicted in FIG. 4A. Next, the respective first and second pieces are, from the flat position, pushed inwardly to form into open ended rectangular tubes or cells or compartments 26*a*, 26*b* as depicted in FIG. 4B. Next, the cells or compartments 26*a*, 26*b* are brought into juxtaposition with one another and the one side of the surface of panel 68', 58', 72', 62' is glued to one another. For example referring to FIG. 4*b*, the panel 68' is glued to panel 58' and simultaneously the panel 72' is glued to panel 62'. In the assembled position, the panels 72' and 58' are now in same plane or aligned with one another. Finally, the respective panels 20*a*', 20*b*' of the wrapper 32 are glued to the respective panels 60*a*, 70*a*, 60*b*, 70*b* to fully construct the container 10. In use, products such as plastic bottle used for anti-freeze, liquid detergents, automotive fluids, bleaches and other fluids or materials are disposed in the contiguous cells or compartments 26*a*, 26*b* and the top wall 14*a*, 14*b* are folded toward one another to cover the compartments 26*a*, 26*b* and finally, the pair of flaps 22*a*, 22*b* are glued to the end walls 18*a*, 18*b* to enclose the container 10 as depicted in FIGS. 2 & 3.

It should be noted that during the formation process, the two cells or compartments 26*a*, 26*b* are formed (each having a partially-overlapping side having been previously laminated and secured) which are foldably connected to the bottom panel 16', each now having non-planar surfaces that can be positioned to face one another. The formation process is intended that adhesive(s) will typically be applied to one or the other non-planar surfaces for the purposes of bonding the adjacent compartments to one another and increasing the durability and stacking strength of the complete package. The bonding glue or agent of two cells or compartments 26*a*, 26*b* can be, among others, hot-melted adhesive, cold white glue such as PVA, any other adhesive which is effective and compatible in the bonding of paper to paper, or any combination of aforementioned adhesives. Furthermore, the adhesive(s) is applied by roller, wiper, spray, sponge or extruding heads and the like. The pattern and location of the adhesive(s) applied may take on any configuration. In some instances, it will be desirable to apply adhesive to the non-planar surfaces of both adjacent compartments.

The application of adhesive(s) in the non-planar surfaces of both adjacent compartments has two main purposes: 1) vertical compressive tests thus far have shown that the presence of adhesive(s) between the non-planar surfaces will increase the vertical compressive strength (measured in inch lbs. of force) of the completed package measurably, compared to an identical package absent of adhesive in this area. Increases of over 5% and under 20% are already documented in the experiment of the test results, as compared to tests of an identical package without adhesive(s) in this area and 2) The bonding of the compartments makes the complete package less vulnerable to central separation during abuses of the complete package, such as dropping or severe jostling or vibration.

Figure 5:
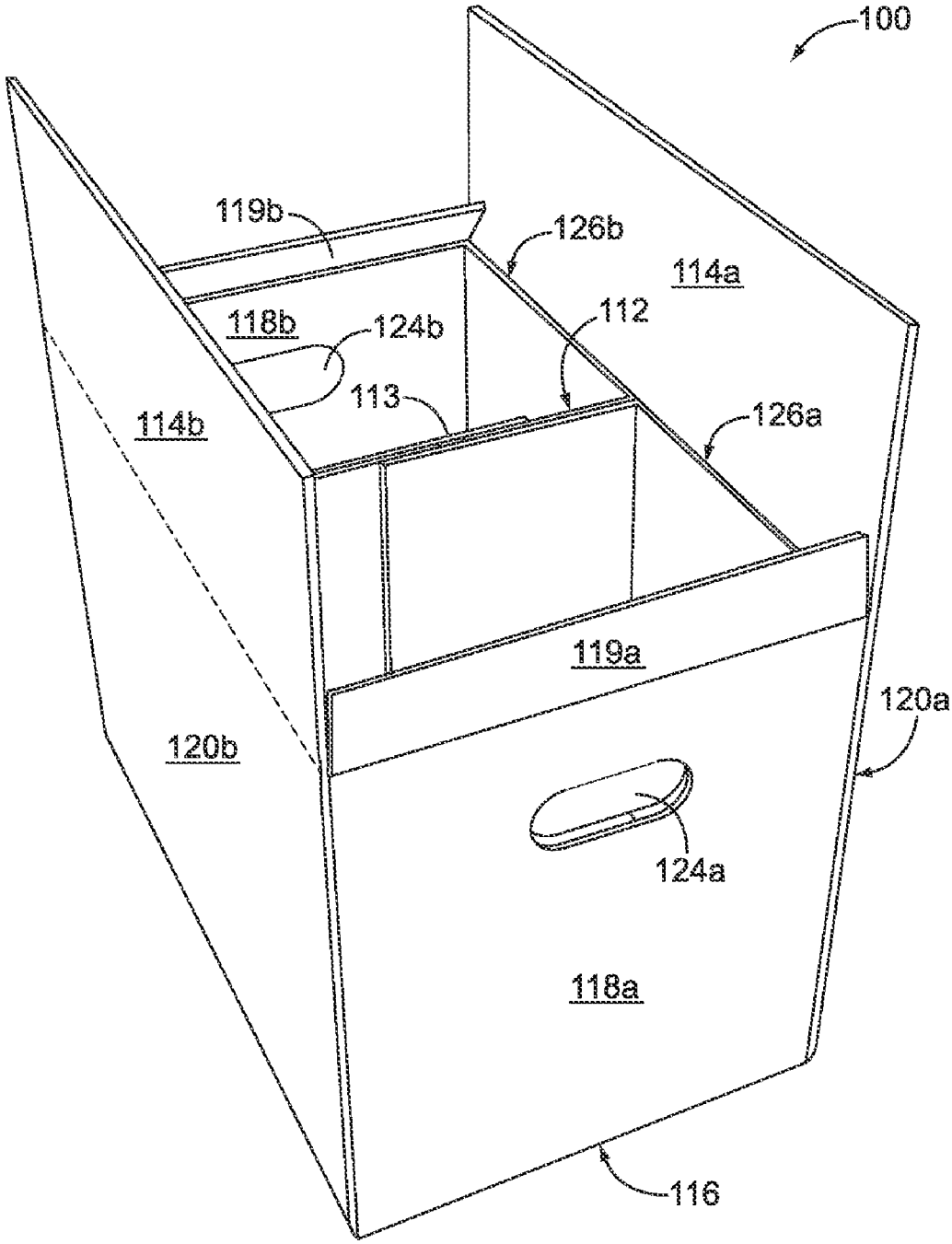
FIG. 5 is a top perspective view of a container comprising an integrally formed partition having a three-wall interleaved center spine constructed therein in an open position in accordance to a second embodiment of the present invention.

FIG. 5 is a top perspective view of a container 100 comprising an integrally formed partition 112 having a three-wall interleaved center spine 113 constructed therein in an open position in accordance to a second embodiment of the present invention. The container 100 comprises opposing top walls 114*a*, 114*b*, bottom wall 116 opposite end walls 118*a*, 118*b*, and opposite side walls 120*a*, and 120*b*. The opposing top and bottom walls 114*a*, 114*b*, and 116 are spaced apart from one another by the opposite end walls 118*a*, 118*b* and the opposite side walls 120*a*, 120*b*. The opposing top walls 114*a*, 114*b* and the bottom wall 116 are foldably joined to longitudinal opposite edges of the side walls 120*a*, 120*b*, and the end walls 118*a*, 118*b* are foldably joined to transverse opposite edges of the side walls 120*a*, 120*b*. Each of the end wall panel 118*a*, 118*b* includes a flap panel 119*a*, 119*b*, respectfully. The opposing top walls 114*a*, 114*b*, bottom wall 116; the opposite end walls 118*a*, 118*b*; and the opposite side walls 20*a*, 20*b* are all cooperating with one another to form the container 100.

Figure 6:
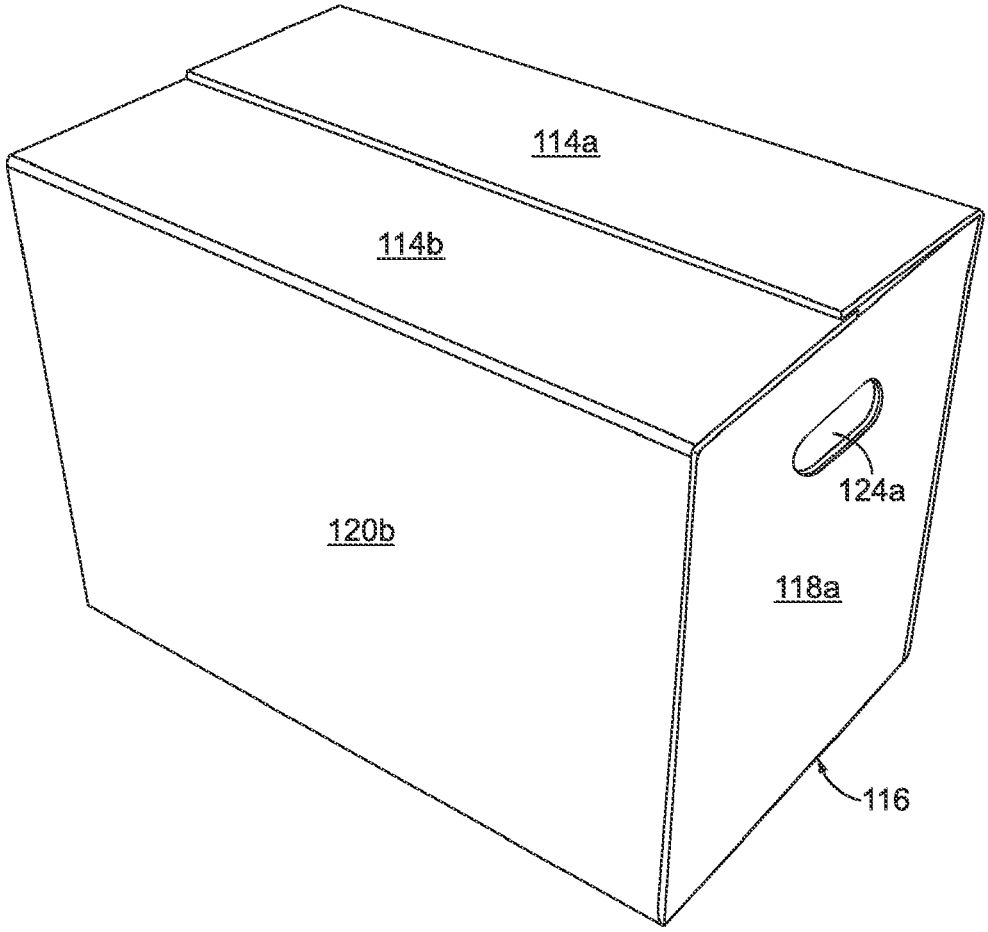
FIG. 6 is a top perspective view of the container in FIG. 5 showing the container in a closed position.

While this specific embodiment has two side walls 120*a*, 120*b* and two end walls 118*a*, 118*b*, the container 100 of the present invention may have any number of side walls or end walls so long as the container's functions described herein are not compromised. The first and second handhold openings 124*a*, 124*b* are formed in the respective end walls 118*a*, 118*b*. It should also be noted that the hand hold openings 124*a*, 124*b* are formed in a manner that affords a user to grab the container 100 by the handhold openings without compromising the interior of the container 100. Accordingly, the handhold openings 124*a*, 124*b* are tamper-resistant that are formed in the end walls 118*a*, 118*b* as shown in FIG. 6. The container 100 may contain any number of handhold openings; however, in the preferred embodiment of the present invention, the container 100 includes two handhold openings 124*a*, 124*b*.

The container 100 includes two contiguous cells or compartments or tubular sections 126*a*, 126*b* defined by the partition 112 having a three-wall interleaved center spine 113. The two cells or compartments 126*a*, 126*b* are identical in shape and define interior spaces of the container 100. The center spine 113 when measured from innermost surface on one side (e.g., compartment 126*a*) to innermost surface on the other side (e.g., compartment 126*b*) is three wall thicknesses and the center spine 113 is interleaved. In use, products such as bottles or the like are disposed in the contiguous cells or compartments 126*a*, 126*b* and the top wall 114*a*, 114*b* are folded toward one another to cover the compartments 126*a*, 126*b*. The container 100 of the present invention is capable of being from any one or more blanks that is capable of being folded and erected to form the container 100. However, in the preferred embodiments of the present invention the container 100 is made from one piece blank.

Figure 7:
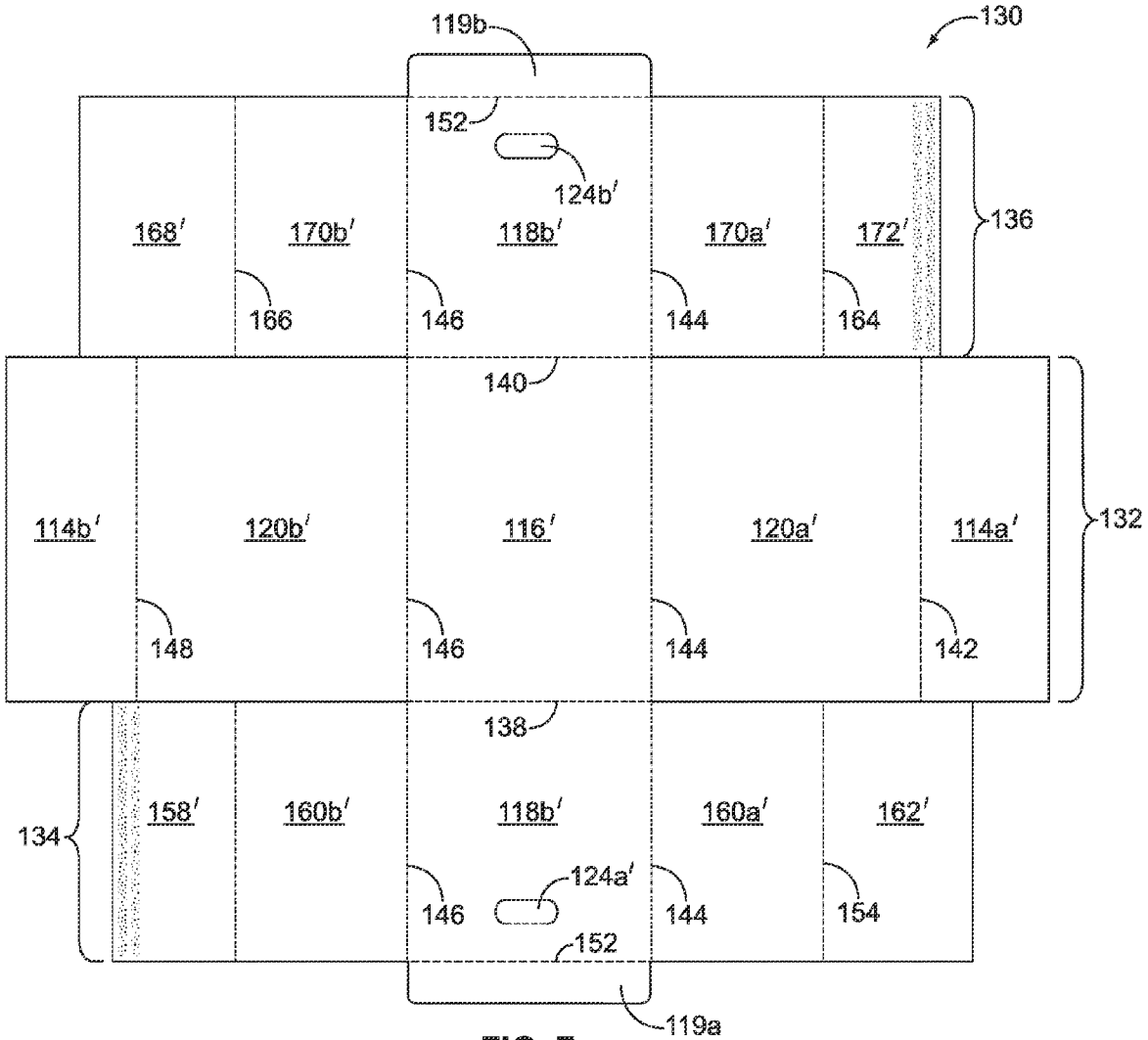
FIG. 7 is a plan view of a cut and scored paperboard blank for forming the container in FIGS. 5 & 6 in accordance to second embodiment of the present invention.

FIG. 7 shows one such blank, more specifically, is a plan view of a cut and scored paperboard blank 130 for forming the container 100 in FIGS. 5 & 6 in accordance to the second embodiment of the present invention.

The blank 130 is divided into three sections 132, 134, and 136 by two substantially parallel longitudinal fold lines 138, 140. Section 132 is defined as a wrapper and sections 134 and 136 are defined as respective first and second end pieces. The wrapper 132 and the first and second end pieces 134 and 136 are foldably attached to one another via fold lines 138, 140. When constructed, the first and second end pieces 134 and 136 forms the respective cells or compartments or tubular sections 126*a*, 126*b* defined by the three-wall interleaved center spine 113. The wrapper 132 is further divided by fold lines 142, 144, 146 and 148 into five panels, namely, a bottom panel 116', two side wall panels 120*a*', 120*b*' and two top wall panels 114*a*', 114*b*'. In the folded position, the two top wall panels 114*a*', 114*b*' form the top walls 114*a*, 114*b*, the two side wall panels 120*a*', 120*b*' form the side wall panels 120*a*, 120*b*, and the bottom wall panel 116' is the bottom wall 116 of the container. The respective flaps 122*a*', 122*b*' are defined by fold lines 152 and extended outwardly from the respective short edges of the top wall panels 114*a*', 114*b*'. The length of the fold lines 138 and 140 is the same as the width of the bottom wall panel 116'.

The first end piece 134 is divided by fold lines 154, 144, 146 and 156 into five panels 154', 160*a*', 118*a*', 160*b*', and 158' which form the cells or compartments or tubular sections 126*a*, when constructed. Similarly, the second end piece 136 is divided by fold lines 164, 144, 146 and 166 into five panels 172, 170*a*', 118*b*', 170*b*, and 168' which form the cells or compartments or tubular sections 126*b*, when constructed. In the first and second pieces 134 and 136, when in folded position, the respective panels 118*a*', 118*b*' form the end walls 118*a*, 118*b* as shown in FIGS. 5 and 6. Each panel 118*a*', 118*b*' includes a respective flap panel 119*a*', 11*b*' define by fold lines 152. The panels 118*a*', 118*b*' are spaced apart from one another by the bottom wall panel 116'. The substantially parallel fold lines 144 and 146 are formed across the width of the blank 130. When folded, the openings 124*a*', 124*b*' in the respective panels 118*a*', 118*b*' form the hand hold openings 124*a*, 124*b* in a manner that affords a user to carry the container 10. The first and second pieces 134 and 136 are formed in a manner that they are asymmetric with respect to the longitudinal axis of the wrapper 132 and they are staggered or out of phase with one another. For example, respective panels 160*a*', 160*b*', 118*a*' and 170*a*', 170*b*', 118*b*' on the opposed side of the wrapper 132 are identical and they are mirror image of one another with respect to the longitudinal side of the wrapper 132. However, respective panels 162' and 168' and respective panels 158' and 172' are identical without being mirror of one another with respect to the longitudinal side of the wrapper 132.

Figure 7A:
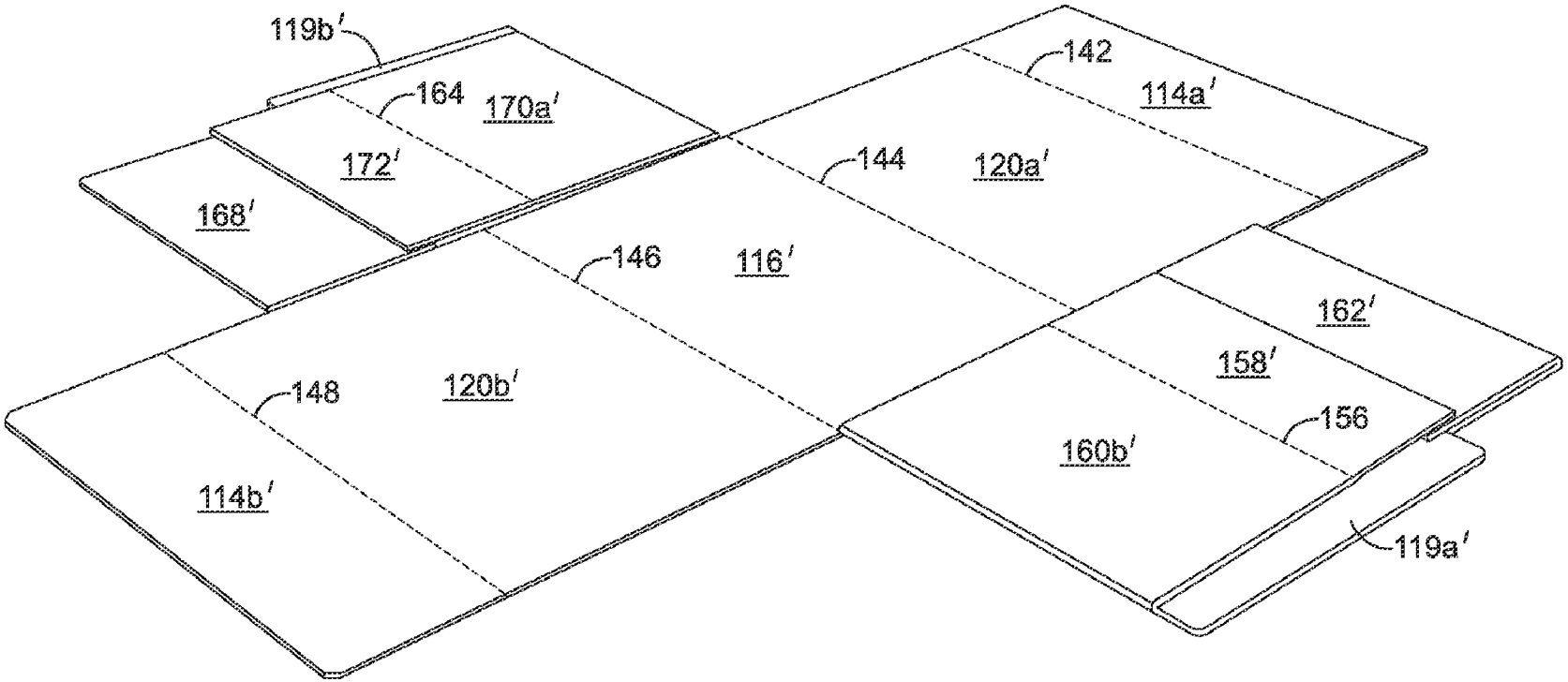
FIGS. 7A, 7B, and 7C illustrate the folding sequences of the blank shown in FIG. 7 to construct the container depicted in FIGS. 5 & 6.
Figure 7B:
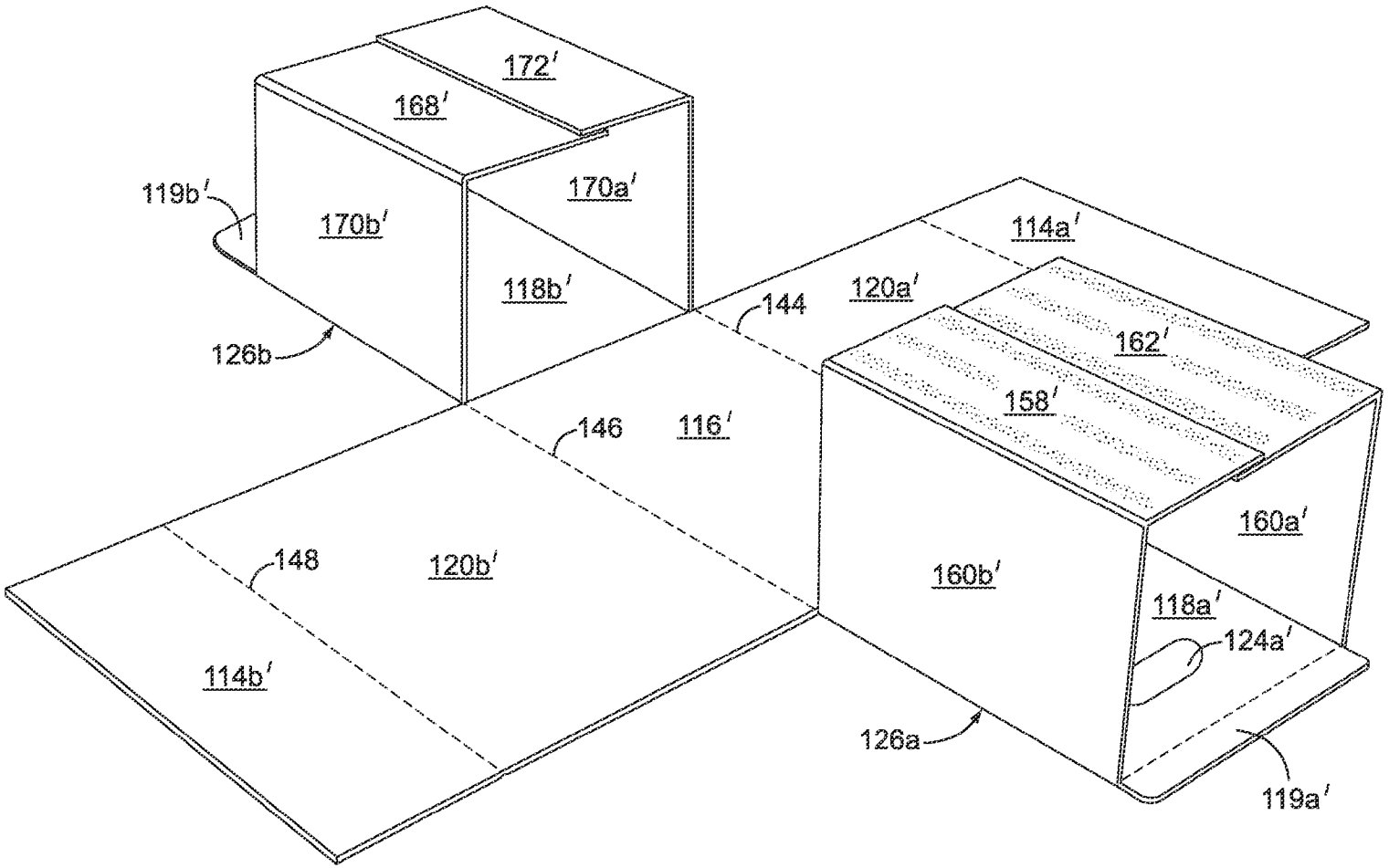
Figure 7C:
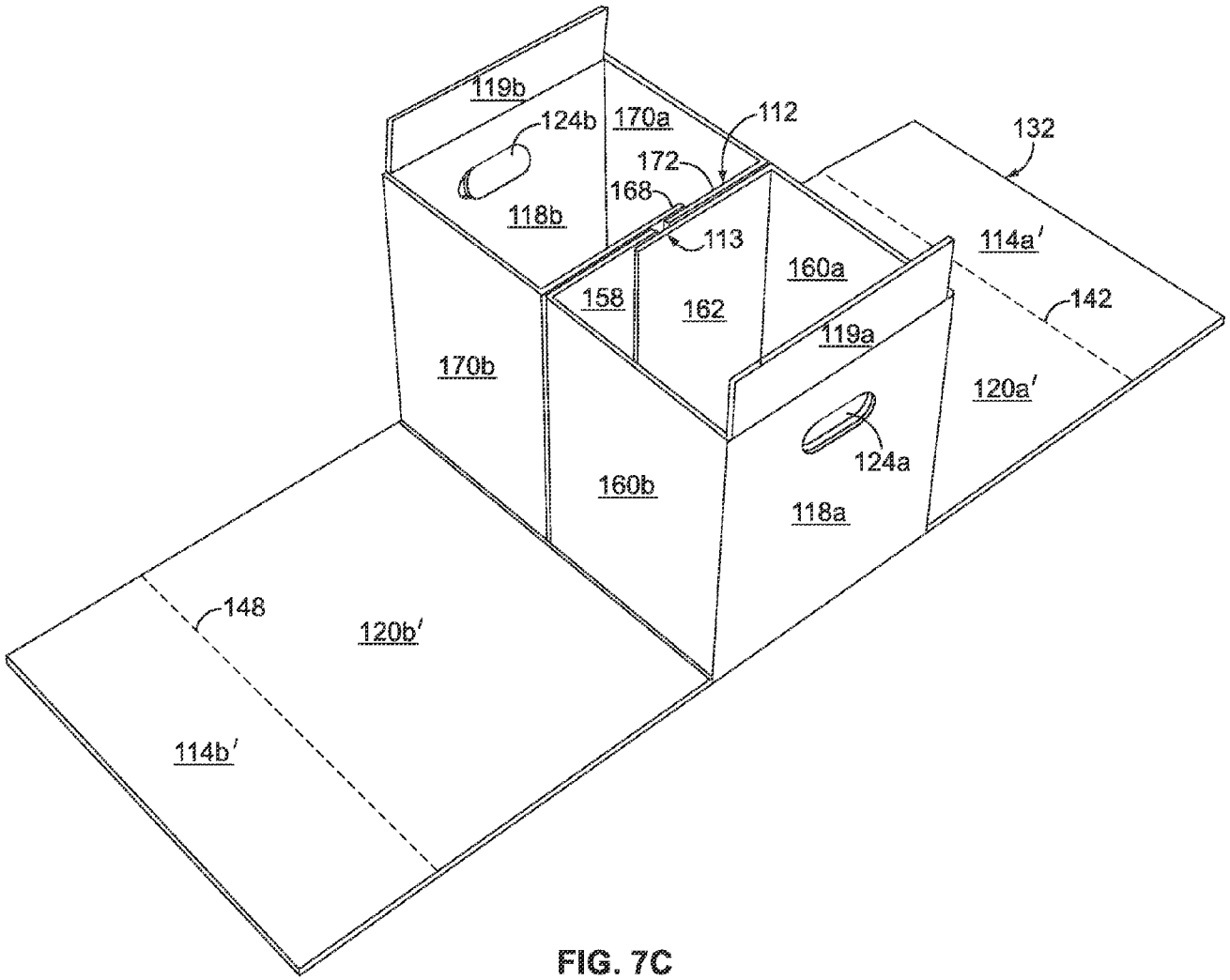

FIGS. 7A, 7B, and 7C illustrate folding sequence of the blank 130 shown in FIG. 7 for constructing the container 100 depicted in FIGS. 5 and 6. It should be noted that the proper size and configuration of these panels are important to construct the cells or compartments or tubular sections 126*a*, 126*b* that are brought into juxtaposition with one another to form the partition 112 having the three-wall interleaved center spine 113 therein. It should also be noted that the partition 112 is configured such that it has a three-wall thickness in the central portion and a two-wall thickness away from the center spine 113. For example, when the cells or compartments or tubular sections 126*a*, 126*b* are brought into juxtaposition with one another, the longitudinal edge of the panel 158' of the cell 126*a* aligned with the longitudinal edge of the panel 172' of the cell 126*b* such that the center spine 113 is interleaved.

The manual or machine set-up of the container 100 is exactly the same as the container 10 and thus is not repeated to avoid redundancy. The container 10 and container 100 are substantially the same except that the flaps 22*a*, 22*b* and flap panel 119*a*, 119*b* are configured differently with respect to the container. In container 10, the flaps 22*a*, 22*b* are used to glue the top walls 14*a*, 14*b* to the end wall panels 18*a*, and 18*b*. In container 100, the flap panels 119*a*, 119*b* are used to support the top wall panels 114*a*, 114*b* when these panels are in folded position.

In sum, the present invention is directed to a container having a bottom wall, first and second opposite sidewalls, opposite end walls, a top wall. An integral interior partition is dividing the container into two side-by-side compartments each adapted for holding a respective article. The container and partition are made from a single unitary blank cut and folded to form the container and partition. The partition comprises a first panel extending inwardly from the first sidewall across the interior of the container toward the second sidewall. A second panel extends inwardly from the second sidewall across the interior of the container toward the first sidewall and into overlapping relationship at an inner edge thereof with an inner edge of the first panel. The first panel having a width greater than the width of the second panel and the overlapped edges of the first and second panels is being offset from the center of the partition toward the second sidewall. A third panel extends inwardly from the first sidewall across the interior of the container toward the second sidewall. A fourth panel extends inwardly from the second sidewall across the interior of the container toward the first sidewall and into overlapping relationship at an inner edge thereof with an inner edge of the third panel. The third panel having a width less than the width of the fourth panel and the overlapped edges of the third and fourth panels is being offset from the center of the partition toward the first sidewall.

The first and third panels lies contiguous to one another with an inner edge of the third panel offset from an inner edge of the first panel toward the first sidewall. And the second and fourth panels lies contiguous to one another with an inner edge of the second panel offset from an inner edge of the fourth panel toward the second sidewall. The inner edges of the second and third panels are being interleaved between inner edges of the first and fourth panels to define a triple wall thickness at a center portion of the partition. The container has a top wall wherein the top wall comprises a top wall panel folded inwardly from a top edge of each of the sidewalls. The adjacent inner edges of the top wall panels overlap one another. A small flap is on opposite outer end edges of each top wall panel. The small flap is folded downwardly over an adjacent end wall and secured thereto.

The present invention is also directed to a container having a bottom wall, opposite sidewalls, opposite end walls, and integral interior partition means dividing the interior of the container into a plurality of side-by-side compartments each adapted for holding a respective article. The container and partition means are made from a single unitary blank cut and folded to form the container and partition. The partition means comprises a first set of two panels extending inwardly partially across the interior of the container from a first of the sidewalls and terminating at inner end edges thereof spaced from a second opposite of the sidewall. A first of the two panels having less width than a second of the two panels so that the inner end edges of the first and second panels of the first set are offset from one another. A second set of two panels extends inwardly partially across the interior of the container from the second of the sidewall and terminating at inner end edges thereof spaced from the first of the sidewall.

A first of the two panels of the second set having less width than a second of the two panels so that the inner end edges of the first and second panels of the second set are offset from one another. The first and second sets of panels are positioned with respect to one another so that the first panels of the first and second sets of panels are in alignment with one another and the inner end edges thereof are in confronting relationship, the second panel of the first set of panels extends alongside of and is secured to one side of the first panels of the first and second sets of panels in spanning relationship to the confronting inner end edges thereof. The second panel of the second set of panels extends alongside of and is secured to an opposite side of the first panels of the first and second sets of panels in spanning relationship to the confronting inner end edges thereof, whereby the first and second panels of the first and second sets of panels are interleaved with one another at inner end edges thereof and the partition means is three panels thick over a center portion thereof and two panels thick over the remainder thereof.

The present invention is further directed to a single unitary blank for making a container having a bottom wall, opposite sidewalls, opposite end walls, and integral interior partition means dividing the interior of the container into a plurality of side-by-side compartments each adapted for holding a respective article. The blank is cut and scored to define a center wrap section and first and second end piece sections on opposite sides of the center wrap section. The center wrap section comprises a centrally disposed bottom wall panel having opposite end edges and opposite side edges. A first outer sidewall panel is foldably joined to a first side edge of the bottom wall panel and a second outer sidewall panel is foldably joined to a second side edge of the bottom wall panel opposite the first side edge thereof. The first end section comprises a first end wall panel foldably joined to a first end edge of the bottom wall panel.

A first inner sidewall panel is foldably joined to one side edge of the first end wall panel and lying adjacent a first edge of the first outer sidewall panel. A second inner sidewall panel is foldably joined to an opposite side edge of the first end wall panel and lying adjacent a first edge of the second outer sidewall panel. A first partition panel is foldably joined to an outer side edge of the first inner sidewall panel and a second partition panel is foldably joined to an outer side edge of the second inner sidewall panel, the second partition panel having less width than the first partition panel. The second end section comprises a second end wall panel foldably joined to a second end edge of the bottom wall panel opposite the first end edge. A third inner sidewall panel is foldably joined to a side edge of the second end wall panel in opposed relationship to the first inner sidewall panel on an opposite side of the blank. A fourth inner sidewall panel is foldably joined to an opposite side edge of said second end wall panel in opposed relationship to the second inner sidewall panel on an opposite side of the blank. A third partition panel is foldably joined to an outer side edge of the third inner sidewall panel in opposed relationship to the first partition panel on an opposite side of the blank. The third partition panel having less width than the first partition panel, and a fourth partition panel is foldably joined to an outer side edge of the fourth inner sidewall panel in opposed relationship to the second partition panel on an opposite side of the blank, the second partition panel having less width than the fourth transverse partition panel. A top wall panel is foldably joined to an outer edge of each the outer sidewall panel. A laterally projecting small flap is foldably joined to each of the opposite outer end edges of each the top wall panel.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container having a bottom wall, first and second opposite sidewalls, opposite end walls, a top wall, and an integral interior partition dividing the container into two contiguous compartments each adapted for holding a respective article, wherein the container and partition are made from a single unitary blank cut and folded to form the container and partition, wherein the partition comprises:

a first panel extending inwardly from the first sidewall across the interior of the container toward the second sidewall;

a second panel extending inwardly from the second sidewall across the interior of the container toward the first sidewall and into overlapping relationship at an inner edge thereof with an inner edge of the first panel, the first panel having a width greater than the width of the second panel and the overlapped edges of the first and second panels being offset from the center of the partition toward the second sidewall;

a third panel extending inwardly from the first sidewall across the interior of the container toward the second sidewall;

a fourth panel extending inwardly from the second sidewall across the interior of the container toward the first sidewall and into overlapping relationship at an inner edge thereof with an inner edge of the third panel, the third panel having a width less than the width of the fourth panel and the overlapped edges of the third and fourth panels being offset from the center of the partition toward the first sidewall;

the first and third panels lying contiguous to one another, with an inner edge of the third panel offset from an inner edge of the first panel toward the first sidewall; and the second and fourth panels lying contiguous to one another, with an inner edge of the second panel offset from an inner edge of the fourth panel toward the second sidewall, the inner edges of the second and third panels being interleaved between inner edges of the first and fourth panels to define a triple wall thickness at a center portion of the partition and wherein the two contiguous compartments rest on the bottom wall.

2. The container of claim 1, wherein the top wall comprises a top wall panel folded inwardly from a top edge of each of the sidewalls.

3. The container of claim 2, wherein adjacent inner edges of the top wall panels overlap one another.

4. The container of claim 3, wherein a small flap is on opposite outer end edges of each top wall panel, the small flap being folded downwardly over the adjacent end wall and secured thereto.

5. A container having a bottom wall, opposite sidewalls, opposite end walls, and integral interior partition means dividing the interior of the container into a plurality of contiguous compartments each adapted for holding a respective article, wherein the container and partition means are made from a single unitary blank cut and folded to form the container and partition, wherein the partition means comprises:

a first set of two panels extending inwardly partially across the interior of the container from a first of the sidewalls and terminating at inner end edges thereof spaced from a second opposite of the sidewall, a first of the two panels having less width than a second of the two panels so that the inner end edges of the first and second panels of the first set are offset from one another;

a second set of two panels extending inwardly partially across the interior of the container from the second of the sidewall and terminating at inner end edges thereof spaced from the first of the sidewall, a first of the two panels of the second set having less width than a second of the two panels so that the inner end edges of the first and second panels of the second set are offset from one another; and the first and second sets of panels being positioned with respect to one another so that the first panels of the first and second sets of panels are in alignment with one another and the inner end edges thereof are in confronting relationship, the second panel of the first set of panels extends alongside of and is secured to one side of the first panels of the first and second sets of panels in spanning relationship to the confronting inner end edges thereof, and the second panel of the second set of panels extends alongside of and is secured to an opposite side of the first panels of the first and second sets of panels in spanning relationship to the confronting inner end edges thereof, whereby the first and second panels of the first and second sets of panels are interleaved with one another at inner end edges thereof and the partition means is three panels thick over a center portion thereof and two panels thick over the remainder thereof and wherein the two contiguous compartments rest on the bottom wall.

6. The container of claim 5, wherein the container has a top wall.

7. The container of claim 6, wherein the top wall comprises a top wall panel folded inwardly from a top edge of each of said sidewalls.

8. The container of claim 7, wherein adjacent inner edges of the top wall panels overlap one another.

9. The container of claim 8, wherein a small flap is on opposite outer end edges of each top wall panel, the flaps being folded downwardly over the adjacent end wall and secured thereto.

10. A single unitary blank for making a container having a bottom wall, opposite sidewalls, opposite end walls, and integral interior partition means dividing the interior of the container into a plurality of contiguous compartments each adapted for holding a respective article, the blank being cut and scored to define a center wrap section and first and second end piece sections on opposite sides of the center wrap section, wherein:

the center wrap section comprises a centrally disposed bottom wall panel having opposite end edges and opposite side edges, a first outer sidewall panel foldably joined to a first side edge of the bottom wall panel, and a second outer sidewall panel foldably joined to a second side edge of the bottom wall panel opposite the first side edge thereof;

the first end section comprises a first end wall panel foldably joined to a first end edge of the bottom wall panel, a first inner sidewall panel foldably joined to one side edge of the first end wall panel and lying adjacent a first edge of the first outer sidewall panel, a second inner sidewall panel foldably joined to an opposite side edge of the first end wall panel and lying adjacent a first edge of the second outer sidewall panel, a first partition panel foldably joined to an outer side edge of the first inner sidewall panel, and a second partition panel foldably joined to an outer side edge of the second inner sidewall panel, the second partition panel having less width than the first partition panel; and the second end section comprises a second end wall panel foldably joined to a second end edge of the bottom wall panel opposite the first end edge, a third inner sidewall panel foldably joined to a side edge of the second end wall panel in opposed relationship to the first inner sidewall panel on an opposite side of the blank, a fourth inner sidewall panel foldably joined to an opposite side edge of said second end wall panel in opposed relationship to the second inner sidewall panel on an opposite side of the blank, a third partition panel foldably joined to an outer side edge of the third inner sidewall panel in opposed relationship to the first partition panel on an opposite side of the blank, the third partition panel having less width than the first partition panel, and a fourth partition panel foldably joined to an outer side edge of the fourth inner sidewall panel in opposed relationship to the second partition panel on an opposite side of the blank, the second partition panel having less width than the fourth transverse partition panel and wherein the two contiguous compartments rest on the bottom wall.

11. The blank of claim 10, wherein a top wall panel is foldably joined to an outer edge of each of the outer sidewall panel.

12. The blank of claim 11, wherein a laterally projecting small flap is foldably joined to each of the opposite outer end edges of each of the top wall panel.

* * * * *